United States Patent [19]

Asick

[11] Patent Number: 4,493,518

[45] Date of Patent: Jan. 15, 1985

[54] EXTRACTOR MEANS MULTI-PLANE INTERCONNECTION SYSTEM

[75] Inventor: John C. Asick, Harrisburg, Pa.

[73] Assignee: AMP Incorporated, Harrisburg, Pa.

[21] Appl. No.: 520,397

[22] Filed: Aug. 4, 1983

[51] Int. Cl.[3] ..... H01R 13/62

[52] U.S. Cl. ..... 339/45 M; 339/47 R

[58] Field of Search ..... 339/45, 46, 47 R, 47 C, 339/49 R

[56] References Cited

U.S. PATENT DOCUMENTS

| | | | |
|---|---|---|---|
| 2,430,011 | 11/1947 | Gillentine | 339/45 M |
| 3,453,586 | 7/1969 | Brendlen | 339/45 M |
| 4,178,051 | 12/1979 | Kocher et al. | 339/45 |
| 4,233,646 | 11/1980 | Leung et al. | 339/45 M |
| 4,313,150 | 1/1982 | Chu | 339/45 M |

FOREIGN PATENT DOCUMENTS

| | | | |
|---|---|---|---|
| 197811 | 11/1978 | France | 339/45 M |
| 627607 | 9/1978 | U.S.S.R. | 339/45 M |

*Primary Examiner*—Joseph H. McGlynn
*Assistant Examiner*—David L. Pirlot
*Attorney, Agent, or Firm*—Russell J. Egan

[57] ABSTRACT

An extractor for removing connectors from high density locations is formed by a pair of hermaphroditic members each pivotally attached to the connector adjacent one end with their opposite ends slidably and pivotally interconnected. Actuation of the extractor causes rotation about the pivots and sliding rotation of the other end to achieve cammed extraction of the connector.

11 Claims, 4 Drawing Figures

EXTRACTOR MEANS MULTI-PLANE INTERCONNECTION SYSTEM

The present invention relates to an extractor for multiple closely spaced connector devices, such as circuit boards, and in particular to an extractor which can be actuated by one hand.

The current stage of electronics technology requires the maximum number of interconnects in the minimum amount of space. This causes problems in both inserting and extracting the connectors. While there are known extraction devices, many of these require two hand operation, it may not always be possible to use such devices because of limited room. Even one hand operated extractors, such as that shown in U.S. Pat. No. 4,178,051, may require too much room for actuation and thus be unusable.

The present invention concerns an extractor for use in a multiplane interconnection system or other high density connector system. Each connector member has an elongated housing of rigid insulative material which carries therein a plurality of electrical terminals, each having at least one portion profiled to mate with a terminal mounted in an associated header assembly and also with an individual conductor or a further terminal. The header assembly includes at least one header member mounted on a first side of a circuit board or the like and containing a plurality of pin terminals which are electrically and mechanically connected to circuitry on the circuit board. The subject extractor is formed by a pair of elongated, rigid hermaphroditic members which are interengaged near one end and have their other ends pivotally attached to the connector. As the extractor members are actuated, they pivot relative to each other and to the connector while engaging the adjacent header or circuit board with a camming action to cause extraction of the connector.

An embodiment of the present invention will now be described, by way of example, with reference to the accompanying drawings, in which.

Figure 1:
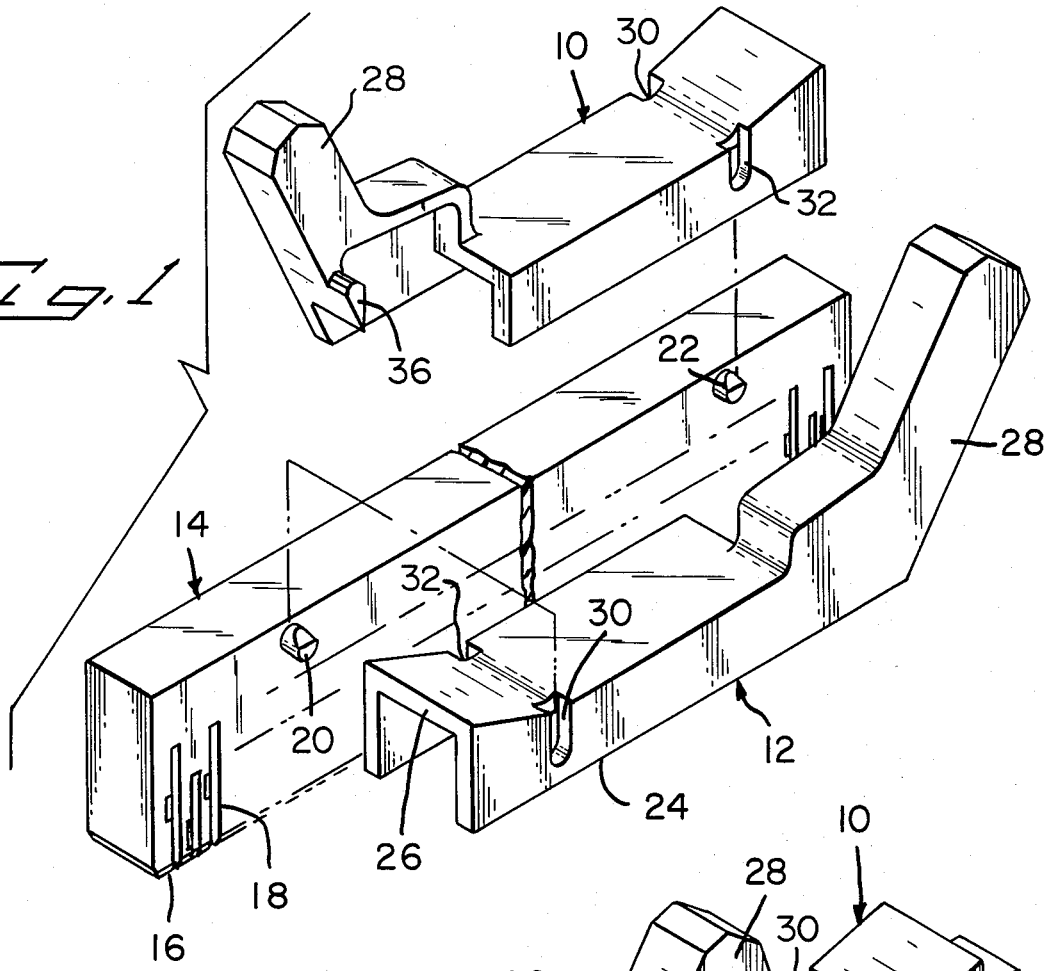
FIG. 1 is an exploded perspective view of the subject invention.

The subject extractor is operable with a single hand and is formed by a pair of hermaphroditic extractor members 10, 12 mounted on a connector 14. The connector 14 is an elongated member of rigid insulative material having a mating face 16 with a plurality of parallel spaced terminal slots 18 opening onto the mating face. The connector also includes pairs of integral spaced lugs 20, 22 on opposite sides and at opposite ends of the connector.

Each extractor member 10, 12 is an elongated member of rigid insulative material having a channel shaped central portion 24, with a canted open first end 26 and a canted opposite handle end 28, which is half the width of the remainder of the member. A pair of lug receiving recesses 30, 32 are formed in each member adjacent the intersection of the channel shaped central portion 24 and the canted open first end 26. The half width handle end has an inwardly directed cavity 34, forming an extension of the channel profile, and an inwardly extending profiled cam lug 36.

Figure 3:
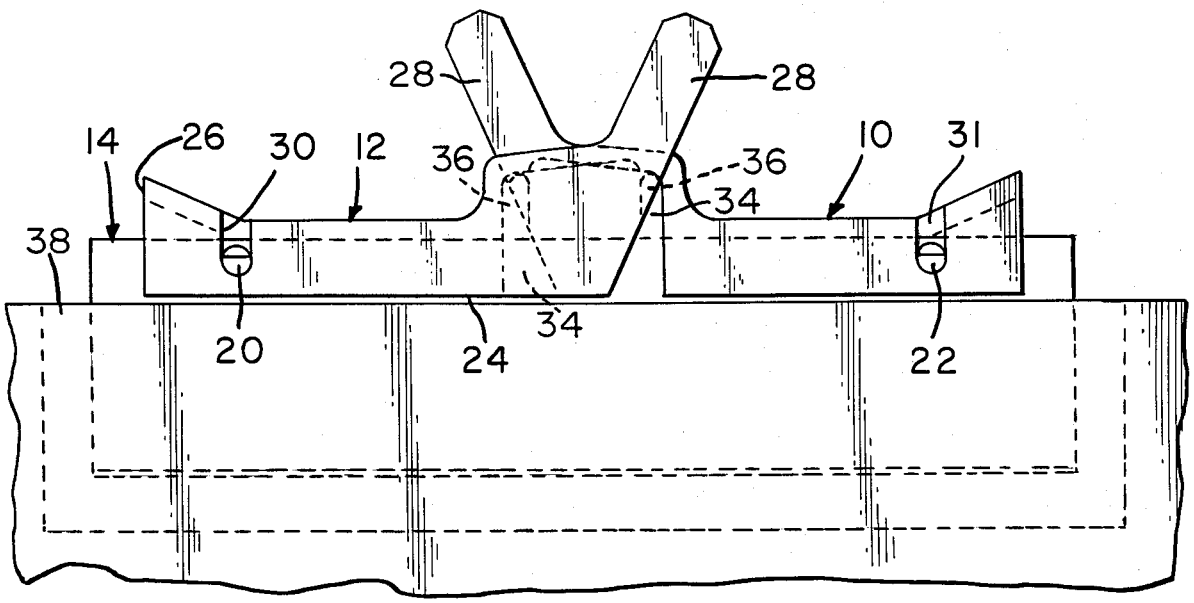
FIG. 3 is a side elevation of the subject invention in a mated condition.
Figure 4:
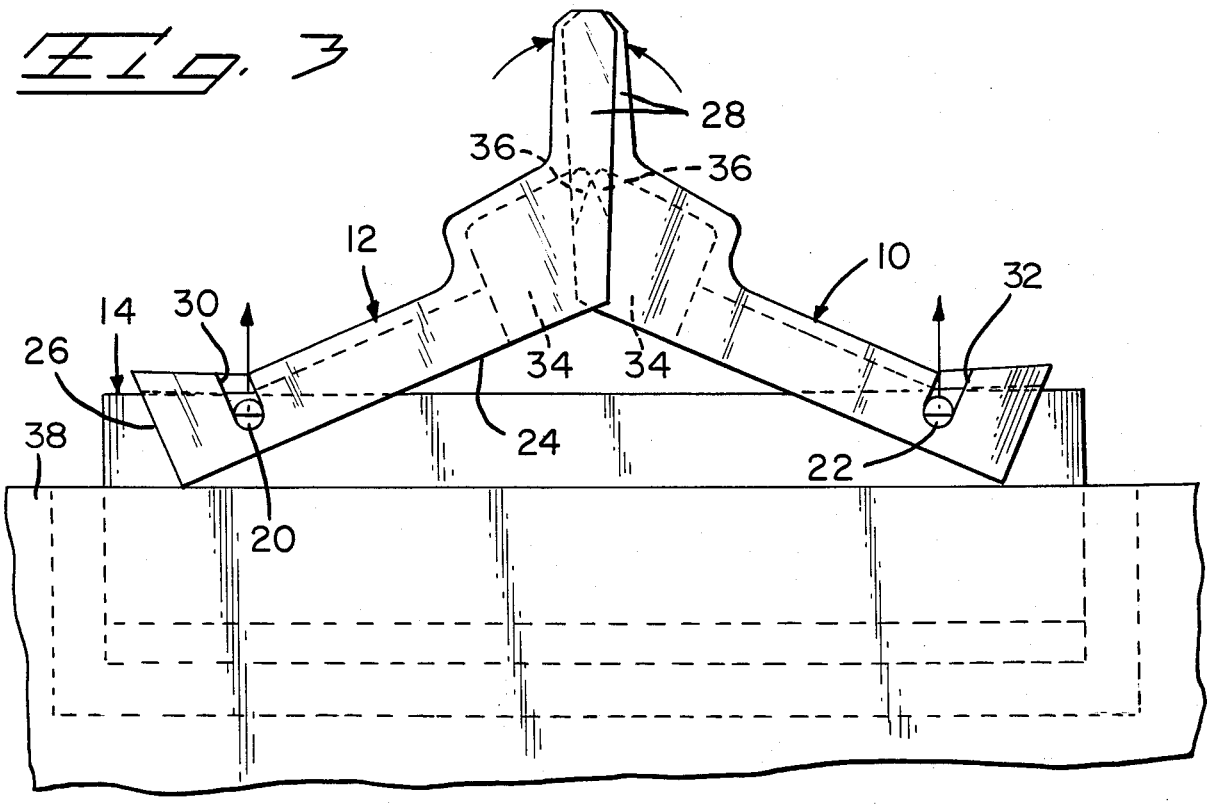
FIG. 4 is a similar side elevation showing the subject invention actuated for extraction.

The subject invention is assembled by fitting the recesses 30, 30 of the extractor members 10, 12 on the respective pairs of lugs 20, 22 with the profiled cam lug 36 of each member being received in the cavity 34 of the opposite member, as seen in phantom in FIGS. 3 and 4.

Figure 2:
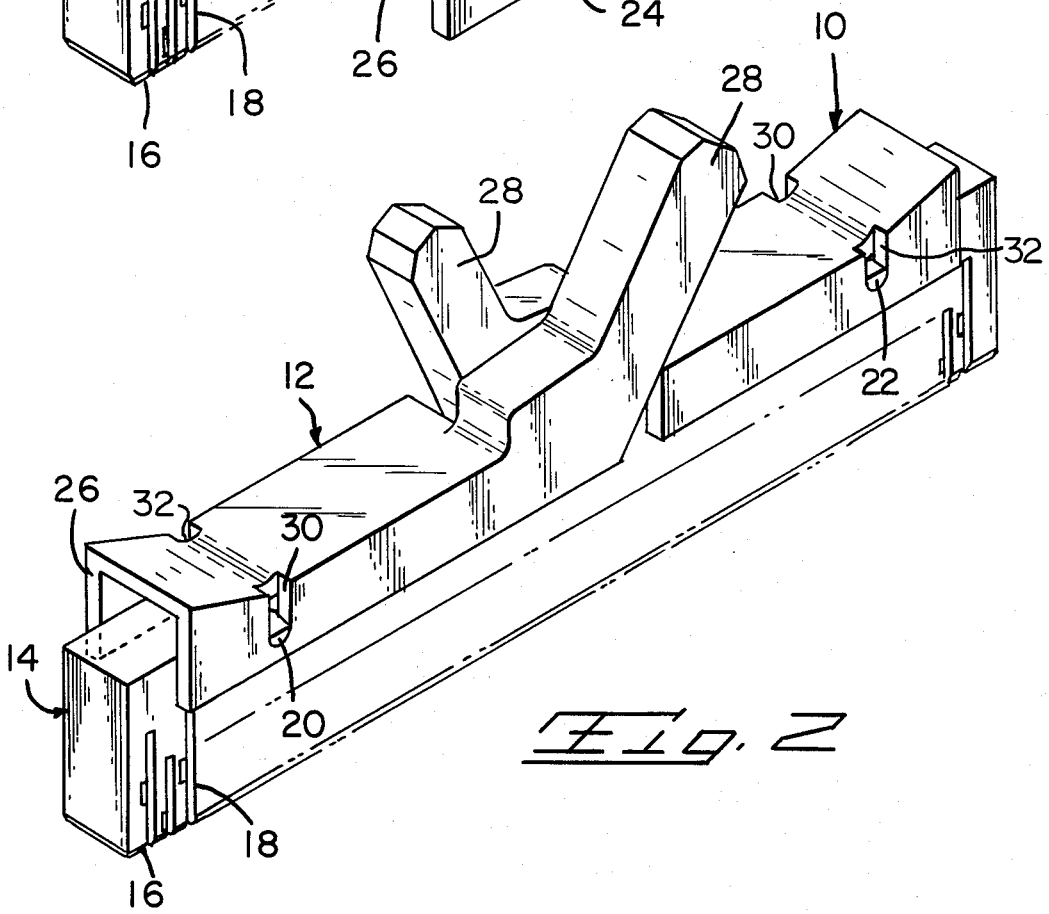
FIG. 2 is a perspective view of the subject invention in a fully assembled condition.

It will be appreciated from FIGS. 3 and 4 that the handles 28 will be closely spaced allowing activation by one hand. Squeezing the handles 28 causes the members to pivot about lugs 20, 22 while the profiled cam lugs 36 slide across the opposing cavity 34. The edges of the firt portions 26 engage the header 38, circuit board or the like, and cam the connector 14 out of contact. For remating, the extractor members 10, 12 would be released and returned to the position of FIGS. 2 and 3. The connector 14 is then simply applied to the header 36 in conventional fashion.

I claim:

1. In combination with an electrical connector having mateable plug and receptacle members each formed of rigid insulative material and carrying an array of electrical terminals therein, said plug member having at least one pivot stud at each end thereof, an extraction means to withdraw said plug member from said receptacle member and comprising a pair of elongated hermaphroditic members each having oppositely directed first and second ends, said first end being canted from the longitudinal axis of the elongated member to define a handle, a chamber formed in each said elongated member adjacent said handle and an integral lug at one side of said chamber directed to be received in the chamber of the other of said elongated members, the second end defining a channel shape with pivot stud receiving apertures aligned in opposite sidewalls whereby squeezing said handles together causes pivotal movement of said elongated members about the respective pivot studs, a camming action of said second ends against said receptacle member, and relative movement of said first ends.

2. The combination according to claim 1 wherein said elongated members are approximately half width at their first ends as compared to their second ends.

3. The combination according to claim 1 wherein a base of said channel shaped second end is angled with respect to the longitudinal axis of said elongated member whereby rotation about said pivot stud is limited.

4. The combination according to claim 1 wherein said elongated members are made of insulative material.

5. Means for extracting an electrical connector plug from a mating electrical receptacle, said extraction means comprising a pair of elongated hermaphroditic members each having oppositely directed first and second ends, each first end defining a handle and means to slidingly engage the other of said members, each said second end having means to pivotally engage said plug and means to engage said receptacle with a cam action, whereby activation of said handles causes rotation of said members about said pivots to extract said plug from said receptacle by cam action.

6. Means for extracting an electrical connector plug from a mating electrical receptacle according to claim 5 wherein said members are approximately half width at their first ends as compared to their second ends whereby said first ends can overlap without increasing the width of the extraction means.

7. Means for extracting an electrical connector plug from a mating electrical receptacle according to claim 5 wherein said means to slidingly engage the other of said members comprises: a chamber formed in each said member adjacent said handle and an integral lug at one side of said chamber directed to be slidingly received in the chamber of the other of said members.

8. Means for extracting an electrical connector plug for a mating electrical receptacle according to claim 5 wherein said handles are canted from the longitudinal axis of the respective members.

9. Means for extracting an electrical connector plug from a mating electrical receptacle according to claim 5 wherein said second end of each said member defines a channel shape with parallel spaced sidewalls and an integral base, said means to pivotally engage said plug being in said sidewalls.

10. Means for extracting an electrical connector plug from a mating electrical receptacle according to claim 9 wherein said cam action is performed by the free edges of said sidewalls.

11. Means for extracting an electrical connector plug from a mating electrical receptacle according to claim 9 wherein said base is canted toward the second end whereby rotational movement of said member is restrained by engagement with said plug member.

* * * * *